US011905963B1

(12) United States Patent
Rashidi

(10) Patent No.: US 11,905,963 B1
(45) Date of Patent: Feb. 20, 2024

(54) COMPRESSOR STARTUP

(71) Applicant: Saudi Arabian Oil Company, Dhahran (SA)

(72) Inventor: Talal H. Rashidi, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/991,290

(22) Filed: Nov. 21, 2022

(51) Int. Cl.
*F04D 27/02* (2006.01)
*F04D 27/00* (2006.01)

(52) U.S. Cl.
CPC ..... *F04D 27/0246* (2013.01); *F04D 27/002* (2013.01); *F04D 27/0215* (2013.01)

(58) Field of Classification Search
CPC ..... F04D 15/0011; F04D 27/009; F04D 27/0207; F04D 27/0215; F04D 27/0246
See application file for complete search history.

(56) References Cited

U.S. PATENT DOCUMENTS 6,442,941 B1 * 9/2002 Anand ..... F02C 7/32 60/39.182
10,648,402 B2 * 5/2020 Yashiro ..... F02D 41/04

FOREIGN PATENT DOCUMENTS

KR 20170030138 A * 3/2017

OTHER PUBLICATIONS

Beigiparast et al., "Flare gas reduction in an olefin plant under different start-up procedures," Energy 214, 2021, 118927, 11 pages.
Ristanovic et al., "Large Synchronous Motors as Drivers for Centrifugal Compressors in LNG Liquefaction Plants," IEEE Transactions on Industry Applications, Nov.-Dec. 2020, 56(6), 11 pages.
Taher et al., "Matching of Synchronous Motors and Centrifugal Compressors: Oil and Gas Industry Practice," Proceedings of ASME Turbo Expo 2020, Turbomachinery Technical Conference and Exposition, Virtual, Sep. 21-25, 2020, 22 pages.

* cited by examiner

*Primary Examiner* — Courtney D Heinle
*Assistant Examiner* — Danielle M. Christensen
(74) *Attorney, Agent, or Firm* — Fish & Richardson P.C.

(57) ABSTRACT

A suction throttling valve adjusts flow of a process gas through an inlet flowline. A compressor pressurizes the process gas. An outlet flowline flows the process gas from the compressor. An anti-surge flowline branching from the outlet flowline directs a first portion of the process gas from the outlet flowline back to the inlet flowline. The anti-surge flowline is connected to the inlet flowline intermediate of the suction throttling valve and the compressor. An anti-surge control valve adjusts flow of the first portion of the process gas through the anti-surge flowline to the inlet flowline. A bypass flowline provides an alternative flow path for a second portion of the process gas flowing through the anti-surge flowline to the inlet flowline around the suction throttling valve. A bypass control valve adjusts flow of the second portion of the process gas through the bypass flowline.

20 Claims, 3 Drawing Sheets

100A

100A

100B

COMPRESSOR STARTUP

TECHNICAL FIELD

This disclosure relates to startup of compressors.

BACKGROUND

A compressor is a mechanical device that increases the pressure of a gas by reducing its volume. Thus, compressors can facilitate transport of gases. Two main categories of compressors include positive displacement compressors and dynamic compressors. One example of a dynamic compressor is a centrifugal compressor. Centrifugal compressors use an impeller is a shaped housing (also referred to as casing) which forces the gas to the rim of the impeller, thereby increasing the velocity of the gas. To pressurize the gas, a diffuser section of the centrifugal compressor converts the velocity energy into pressure energy. For safety and reliability, centrifugal compressors are designed to rapidly shutdown (also referred to as trip) in the event of a fault condition, such as high vibration, loss of lube oil, or another alarm condition. In such cases, the centrifugal compressor must be restarted to continue operations.

SUMMARY

This disclosure describes technologies relating to startup of compressors, and in particular, startup of centrifugal compressors. Certain aspects of the subject matter described can be implemented as a method. A suction throttling valve adjusts flow of a process gas through an inlet flowline. A compressor downstream of the suction throttling valve pressurizes the process gas. An outlet flowline flows the process gas from the compressor. An anti-surge flowline branching from the outlet flowline directs a first portion of the process gas from the outlet flowline back to the inlet flowline. The anti-surge flowline is connected to the inlet flowline intermediate of the suction throttling valve and the compressor. An anti-surge control valve adjusts flow of the first portion of the process gas through the anti-surge flowline to the inlet flowline. A bypass flowline branching from the anti-surge flowline directs a second portion of the process gas from the anti-surge flowline to the inlet flowline. The bypass flowline is connected to the inlet flowline upstream of the suction throttling valve. The bypass flowline provides an alternative flow path for the second portion of the process gas flowing through the anti-surge flowline to the inlet flowline around the suction throttling valve. A bypass control valve adjusts flow of the second portion of the process gas through the bypass flowline to the inlet flowline around the suction throttling valve.

This, and other aspects, can include one or more of the following features. A compressor rotation speed of the compressor can be determined. The compressor rotation speed can be compared with a specified rated speed. The bypass control valve can be closed in response to determining that the compressor rotation speed has reached the specified rated speed, thereby shutting off flow of the second portion of the process gas through the bypass flowline. A flow rate of the process gas flowing through the compressor can be determined. The flow rate of the process gas flowing through the compressor can be compared with a specified minimum flow rate. The anti-surge control valve can be opened in response to determining that the flow rate of the process gas flowing through the compressor has dropped to the specified minimum flow rate. It can be determined whether a percent opening of the anti-surge control valve has increased. For example, a controller can determine whether the percent opening of the anti-surge control valve has increased (for example, has opened from 0% (previously closed position)). The bypass control valve can be opened in response to determining that the percent opening of the anti-surge control valve has increased. The bypass control valve can be a tight shut off valve. A ratio of an inner diameter of the bypass flowline to an inner diameter of the anti-surge flowline can be in a range of from 8:26 to 12:22. A ratio of the inner diameter of the bypass flowline to an inner diameter of the inlet flowline can be in a range of from 8:32 to 12:28. A ratio of the inner diameter of the bypass flowline to an inner diameter of the outlet flowline can be in a range of from 8:20 to 12:16.

Certain aspects of the subject matter described can be implemented as a method. A suction throttling valve adjusts flow of a process gas through an inlet flowline. A compressor downstream of the suction throttling valve pressurizes the process gas. An outlet flowline flows the process gas from the compressor. An anti-surge flowline branching from the outlet flowline directs a first portion of the process gas from the outlet flowline back to the inlet flowline. The anti-surge flowline is connected to the inlet flowline intermediate of the suction throttling valve and the compressor. An anti-surge control valve adjusts flow of the first portion of the process gas through the anti-surge flowline to the inlet flowline. A bypass flowline branching from the inlet flowline directs a second portion of the process gas from the anti-surge flowline to the inlet flowline upstream of the suction throttling valve. The bypass flowline branches from the inlet flowline intermediate of the suction throttling valve and a point at which the anti-surge flowline is connected to the inlet flowline, and the bypass flowline connects back to the inlet flowline upstream of the suction throttling valve. The bypass flowline provides an alternative flow path for the second portion of the process gas flowing through the anti-surge flowline to the inlet flowline around the suction throttling valve. A bypass control valve adjusts flow of the second portion of the process gas through the bypass flowline to the inlet flowline around the suction throttling valve.

Certain aspects of the subject matter described can be implemented as a system. The system includes an inlet flowline, a suction throttling valve, a compressor, an outlet flowline, an anti-surge flowline, an anti-surge control valve, a bypass flowline, and a bypass control valve. The inlet flowline is configured to flow a process gas. The suction throttling valve is installed on the inlet flowline. The suction throttling valve is configured to control flow of the process gas through the inlet flowline. The compressor is downstream of the suction throttling valve. The compressor is configured to pressurize the process gas. The outlet flowline is configured to flow the process gas from the compressor. The anti-surge flowline branches from the outlet flowline. The anti-surge flowline is connected to the inlet flowline intermediate of the suction throttling valve and the compressor. The anti-surge control valve is installed on the anti-surge flowline. The anti-surge control valve is configured to control flow of a first portion of the process gas from the outlet flowline through the anti-surge flowline to the inlet flowline. The bypass flowline branches from the anti-surge flowline. The bypass flowline is connected to the inlet flowline upstream of the suction throttling valve. The bypass flowline provides an alternative flow path for a second portion of the process gas flowing through the anti-surge flowline to the inlet flowline around the suction throttling valve. The bypass control valve is installed on the bypass flowline. The bypass control valve is configured to control flow of the second portion of the process gas from the anti-surge flowline through the bypass flowline to the inlet flowline around the suction throttling valve.

This, and other aspects, can include one or more of the following features. The system can include a controller. The controller can be communicatively coupled to the compressor. The controller can be communicatively coupled to the suction throttling valve. The controller can be communicatively coupled to the anti-surge control valve. The controller can be communicatively coupled to the bypass control valve. The controller can include one or more processors. The controller can include a transitory or non-transitory computer-readable storage medium that is coupled to the one or more processors. The storage medium can store programming instructions for execution by the one or more processors. The programming instructions can instruct the one or more processors to perform operations. The operations can include determining a compressor rotation speed of the compressor. The operations can include comparing the compressor rotation speed with a specified rated speed. The operations can include transmitting a close signal to the bypass control valve in response to determining that the compressor rotation speed has reached the specified rated speed. The operations can include determining a flow rate of the process gas flowing through the compressor. The operations can include comparing the flow rate of the process gas flowing through the compressor with a specified minimum flow rate. The operations can include transmitting an open signal to the anti-surge control valve to open the anti-surge control valve in response to determining that the flow rate of the process gas flowing through the compressor has dropped to the specified minimum flow rate. The operations can include determining whether a percent opening of the anti-surge control valve has increased. The operations can include transmitting a second open signal to the bypass control valve to open the bypass control valve in response to determining that the percent opening of the anti-surge control valve has increased. The bypass control valve can be a tight shut off valve. A ratio of an inner diameter of the bypass flowline to an inner diameter of the anti-surge flowline can be in a range of from 8:26 to 12:22. A ratio of the inner diameter of the bypass flowline to an inner diameter of the inlet flowline can be in a range of from 8:32 to 12:28. A ratio of the inner diameter of the bypass flowline to an inner diameter of the outlet flowline can be in a range of from 8:20 to 12:16.

Certain aspects of the subject matter described can be implemented as a system. The system includes an inlet flowline, a suction throttling valve, a compressor, an outlet flowline, an anti-surge flowline, an anti-surge control valve, a bypass flowline, and a bypass control valve. The inlet flowline is configured to flow a process gas. The suction throttling valve is installed on the inlet flowline. The suction throttling valve is configured to control flow of the process gas through the inlet flowline. The compressor is downstream of the suction throttling valve. The compressor is configured to pressurize the process gas. The outlet flowline is configured to flow the process gas from the compressor. The anti-surge flowline branches from the outlet flowline. The anti-surge flowline is connected to the inlet flowline intermediate of the suction throttling valve and the compressor. The anti-surge control valve is installed on the anti-surge flowline. The anti-surge control valve is configured to control flow of a first portion of the process gas from the outlet flowline through the anti-surge flowline to the inlet flowline. The bypass flowline branches from the inlet flowline intermediate of the suction throttling valve and a point at which the anti-surge flowline is connected to the inlet flowline. The bypass flowline connects back to the inlet flowline upstream of the suction throttling valve. The bypass flowline provides an alternative flow path for a second portion of the process gas flowing through the anti-surge flowline to the inlet flowline around the suction throttling valve. The bypass control valve is installed on the bypass flowline. The bypass control valve is configured to control flow of the second portion of the process gas from the anti-surge flowline through the bypass flowline to the inlet flowline around the suction throttling valve.

Certain aspects of the subject matter described can be implemented as a system. The system includes an inlet flowline, a suction throttling valve, a compressor, an outlet flowline, an anti-surge flowline, an anti-surge control valve, a bypass flowline, a bypass control valve, and a controller. The inlet flowline is configured to flow a process gas. The suction throttling valve is installed on the inlet flowline. The suction throttling valve is configured to control flow of the process gas through the inlet flowline. The compressor is downstream of the suction throttling valve. The compressor is configured to pressurize the process gas. The outlet flowline is configured to flow the process gas from the compressor. The anti-surge flowline branches from the outlet flowline. The anti-surge flowline is connected to the inlet flowline intermediate of the suction throttling valve and the compressor. The anti-surge control valve is installed on the anti-surge flowline. The anti-surge control valve is configured to control flow of a first portion of the process gas from the outlet flowline through the anti-surge flowline to the inlet flowline. The bypass flowline branches from the anti-surge flowline. The bypass flowline is connected to the inlet flowline upstream of the suction throttling valve. The bypass flowline provides an alternative flow path for a second portion of the process gas flowing through the anti-surge flowline to the inlet flowline around the suction throttling valve. The bypass control valve is installed on the bypass flowline. The bypass control valve is configured to control flow of the second portion of the process gas from the anti-surge flowline through the bypass flowline to the inlet flowline around the suction throttling valve. The controller is communicatively coupled to the compressor. The controller is communicatively coupled to the suction throttling valve. The controller is communicatively coupled to the anti-surge control valve. The controller is communicatively coupled to the bypass control valve. The controller includes one or more processors. The controller includes a transitory or non-transitory computer-readable storage medium. The storage medium is coupled to the one or more processors. The storage medium stores programming instructions for execution by the one or more processors. The programming instructions instruct the one or more processors to perform operations. The operations include determining a compressor rotation speed of the compressor. The operations include comparing the compressor rotation speed with a specified rated speed. The operations include transmitting a close signal to the bypass control valve in response to determining that the compressor rotation speed has reached the specified rated speed.

This, and other aspects, can include one or more of the following features. The operations can include determining a flow rate of the process gas flowing through the compressor. The operations can include comparing the flow rate of the process gas flowing through the compressor with a specified minimum flow rate. The operations can include transmitting an open signal to the anti-surge control valve to open the anti-surge control valve in response to determining that the flow rate of the process gas flowing through the compressor has dropped to the specified minimum flow rate. The operations can include determining whether a percent opening of the anti-surge control valve has increased. The operations can include transmitting a second open signal to the bypass control valve to open the bypass control valve in response to determining that the percent opening of the anti-surge control valve has increased. The bypass control valve can be a tight shut off valve. A ratio of an inner diameter of the bypass flowline to an inner diameter of the anti-surge flowline can be in a range of from 8:26 to 12:22. A ratio of the inner diameter of the bypass flowline to an inner diameter of the inlet flowline can be in a range of from 8:32 to 12:28. A ratio of the inner diameter of the bypass flowline to an inner diameter of the outlet flowline can be in a range of from 8:20 to 12:16.

Certain aspects of the subject matter described can be implemented as a system. The system includes an inlet flowline, a suction throttling valve, a compressor, an outlet flowline, an anti-surge flowline, an anti-surge control valve, a bypass flowline, a bypass control valve, and a controller. The inlet flowline is configured to flow a process gas. The suction throttling valve is installed on the inlet flowline. The suction throttling valve is configured to control flow of the process gas through the inlet flowline. The compressor is downstream of the suction throttling valve. The compressor is configured to pressurize the process gas. The outlet flowline is configured to flow the process gas from the compressor. The anti-surge flowline branches from the outlet flowline. The anti-surge flowline is connected to the inlet flowline intermediate of the suction throttling valve and the compressor. The anti-surge control valve is installed on the anti-surge flowline. The anti-surge control valve is configured to control flow of a first portion of the process gas from the outlet flowline through the anti-surge flowline to the inlet flowline. The bypass flowline branches from the inlet flowline intermediate of the suction throttling valve and a point at which the anti-surge flowline is connected to the inlet flowline. The bypass flowline connects back to the inlet flowline upstream of the suction throttling valve. The bypass flowline provides an alternative flow path for a second portion of the process gas flowing through the anti-surge flowline to the inlet flowline around the suction throttling valve. The bypass control valve is installed on the bypass flowline. The bypass control valve is configured to control flow of the second portion of the process gas from the anti-surge flowline through the bypass flowline to the inlet flowline around the suction throttling valve. The controller is communicatively coupled to the compressor. The controller is communicatively coupled to the suction throttling valve. The controller is communicatively coupled to the anti-surge control valve. The controller is communicatively coupled to the bypass control valve. The controller includes one or more processors. The controller includes a transitory or non-transitory computer-readable storage medium. The storage medium is coupled to the one or more processors. The storage medium stores programming instructions for execution by the one or more processors. The programming instructions instruct the one or more processors to perform operations. The operations include determining a compressor rotation speed of the compressor. The operations include comparing the compressor rotation speed with a specified rated speed. The operations include transmitting a close signal to the bypass control valve in response to determining that the compressor rotation speed has reached the specified rated speed.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

Figure 1A:
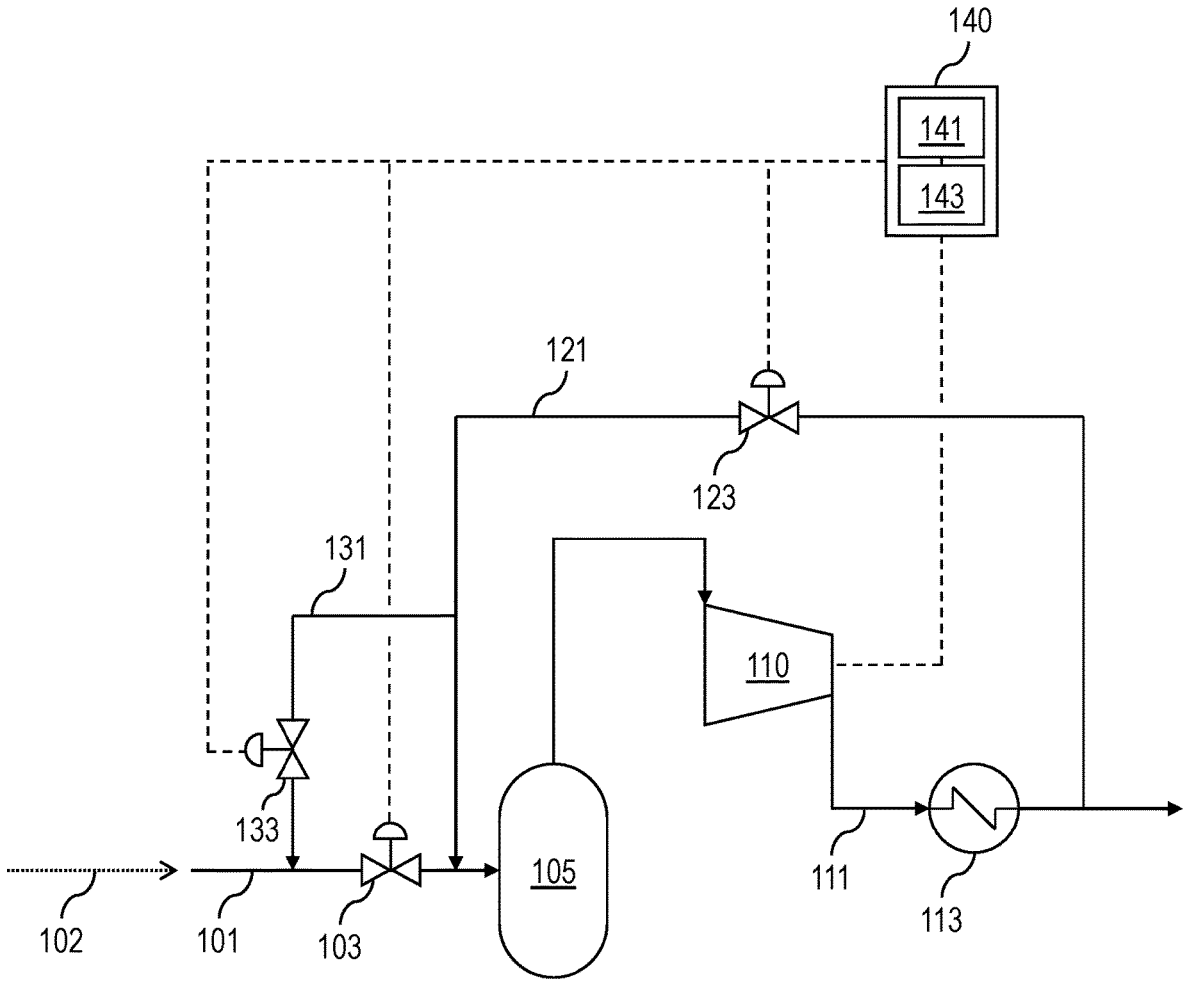
FIG. 1A is a schematic diagram of an example system for soft startup of a centrifugal compressor.

This disclosure describes centrifugal compressor startup. Starting or re-starting a centrifugal compressor from settle-out pressure or even suction pressure can be difficult and in some cases almost impossible due to the high level of torque required by the compressor, especially during acceleration from zero rotation to full rotation speed. Re-starting centrifugal compressors after a trip while avoiding or minimizing load to the flare may require enlarging the compressor motor (and associated electrical system), increasing the capacity of the flare system, or both. Enlarging the compressor motor (and associated electrical system) can be undesirable in relation to increased capital and operating costs. Increasing the capacity of the flare system can also be undesirable in relation to increased capital and operating costs.

The systems and methods described in this disclosure can be implemented to re-start centrifugal compressors after tripping without increasing the load to the flare and without needing to enlarge the compressor motor and associated electrical system. The systems and methods described in this disclosure can be implemented to de-pressurize the compressor circuit to allow for safe soft cold/hot startup of a centrifugal compressor. To do so, a bypass can be added from the anti-surge line around the compressor suction valve. This added bypass line can be used to depressurize the compressor casing pressure and can also be used as a continuous gas de-inventory, which can aid in cold/hot start for the compressor motor until the compressor reaches its rated speed. In some implementations, the bypass line branches from the anti-surge line and ties in with the suction line or header upstream of the suction valve. In some implementations, the bypass line branches from and ties in with the suction line around the suction valve. In both configurations, the bypass line is equipped with a bypass control valve for adjusting flow through the bypass line. The inclusion of the bypass line allows for the compressor casing to de-pressurize from its settle-out pressure to its suction pressure prior to startup, which can aid in soft cold or hot startup of the compressor motor until the compressor reaches its rated rotation speed. The bypass control valve is programmed to integrate with the anti-surge control valve and control system. The control system can automatically modulate the bypass control valve based on operating characteristics of the compressor, such as distance/deviation from surge condition until the compressor motor reaches its rated rotation speed. The systems and methods described in this disclosure can, for example, be applied to fixed speed compressor motors.

The subject matter described in this disclosure can be implemented in particular implementations, so as to realize one or more of the following advantages. The systems and methods described can be implemented to perform startup of a compressor without requiring flaring. The systems and methods described can be implemented to perform startup of a compressor without requiring enlarging the compressor motor and associated electrical system (cost savings). The systems and methods described can be implemented to perform safe and environmentally friendly depressurization of a compressor loop for startup of the compressor after a compressor tripping event. The systems and methods described can be implemented to mitigate and/or eliminate flaring during (and due to) startup of a compressor without requiring a larger compressor motor and associated electrical system. The systems and methods described can be implemented to mitigate and/or eliminate flaring during (and due to) startup of a compressor without requiring gas to be directed to another, existing flare. The systems and methods described can be implemented to mitigate and/or eliminate flaring during (and due to) startup of a compressor without requiring an increase in flaring capacity.

FIG. 1A depicts an example system 100A that can be used for soft startup of a centrifugal compressor 110 (for example, for commissioning the compressor 110 or re-starting the compressor 110 after the compressor 110 has tripped). The system 100A includes an inlet flowline 101 that is configured to flow a process gas 102. The system 100A includes a suction throttling valve 103 that is installed on the inlet flowline 101. The suction throttling valve 103 is configured to control flow of the process gas 102 through the inlet flowline 101. The system 100A includes the compressor 110, which is downstream of the suction throttling valve 103. The compressor 110 is in fluid communication with the inlet flowline 101. The compressor 110 is configured to pressurize the process gas 102. The compressor 110 includes impeller(s) and a motor (not shown). The motor rotates the impeller(s), which compresses the process gas 102 as the process gas 102 flows through the compressor 110. In some implementations, as shown in FIG. 1, the system includes a knockout drum 105 downstream of the suction throttling valve 103 and upstream of the compressor 110. In such implementations, the knockout drum is designed and sized to separate liquid from the process gas 102, such that the process gas 102 entering the compressor 110 is substantially free of liquid. The knockout drum 105 can be included in the system 100A, for example, in cases where some liquid may be expected in the process gas 102. The knockout drum 105 can be omitted from the system 100A, for example, in cases where the process gas 102 is already substantially free of liquid.

The process gas 102 exiting the compressor 110 has a greater operating pressure in comparison to the process gas 102 entering the compressor 110. The system 100A includes an outlet flowline 111 that is configured to flow the process gas 102 from the compressor 110. In some implementations, the system 100A includes a cooler 113 installed on the outlet flowline 111. In general, temperature of the process gas 102 increases as the compressor 110 pressurizes (increases pressure of) the process gas 102. The cooler 113 can be configured to cool the process gas 102 to an operating temperature suitable for a downstream process or user. In cases where the temperature of the process gas 102 that is exiting the compressor 110 is already suitable, the cooler 113 may be omitted.

The system 100A includes an anti-surge flowline 121 that branches from the outlet flowline 111. The anti-surge flowline 121 is a recycle line that diverts at least a portion of the process gas 102 flowing in the outlet flowline 111 back to the suction of the compressor 110, such that the flow rate of the process gas 102 flowing through the compressor 110 remains greater than a minimum surge flow rate, for example, throughout the startup process. The anti-surge flowline 121 is connected to the inlet flowline 101 intermediate of the suction throttling valve 103 and the compressor 110. In some implementations, as shown in FIG. 1, the anti-surge flowline 121 branches from the outlet flowline 111 downstream of the cooler 113 and connects to the inlet flowline 101 downstream of the suction throttling valve 103 and upstream of the knockout drum 105. The system 100A includes an anti-surge control valve 123 that is installed on the anti-surge flowline 121. The anti-surge control valve 123 is configured to control flow of a portion (for example, a first portion) of the process gas 102 from the outlet flowline 111 through the anti-surge flowline 121 to the inlet flowline 101. For example, opening the anti-surge control valve 123 causes a first portion of the process gas 102 to loop and be recycled to the inlet of the compressor 110. The anti-surge flowline 121 (and anti-surge control valve 123) allow for the total flow rate of gas through the compressor 110 to be maintained above a specified minimum flow rate (based on various factors, such as suction pressure of the process gas 102 entering the compressor 110, discharge pressure of the process gas 102 exiting the compressor 110, discharge temperature of the process gas 102 exiting the compressor 110, and average molecular weight of the process gas 102 flowing through the compressor 110), such that surging can be avoided.

The system 100A includes a bypass flowline 131 that branches from the anti-surge flowline 121. The bypass flowline 131 is connected to the inlet flowline 101 upstream of the suction throttling valve 103. The bypass flowline 131 provides an alternative flow path for a portion (for example, a second portion) of the process gas 102 flowing through the anti-surge flowline 121 to the inlet flowline 101 around the suction throttling valve 103. The second portion of the process gas 102 flowing through the bypass flowline 131 can, for example, be a portion of the first portion of the process gas 102 flowing through the anti-surge flowline 121. The system 100A includes a bypass control valve 133 that is installed on the bypass flowline 131. The bypass control valve 133 is configured to control flow of the second portion of the process gas 102 from the anti-surge flowline 121 through the bypass flowline 131 to the inlet flowline 101. The bypass flowline 131 (and bypass control valve 133) allow for the casing of the compressor 110 to depressurize, for example, from a settle-out pressure (once a compressor tripping event has occurred) to the suction pressure before re-starting the compressor 110. The bypass flowline 131 (and bypass control valve 133) can be used, for example, for continuous gas de-inventorying within the recycle loop through the anti-surge flowline 121. Continuous gas de-inventorying through the bypass flowline 131 can facilitate cold or hot startup of the motor of the compressor 110 until the compressor 110 reaches its rated (for example, normal operating) speed. The bypass flowline 131 (and bypass control valve 133) can be used, for example, in conjunction with the anti-surge flowline 121 (and anti-surge control valve 123) for avoiding surging of the compressor 110. In some implementations, the bypass control valve 133 is a tight shut off valve, such that when the bypass control valve 133 is closed, flow of the process gas 102 through the bypass control valve 133 is prevented (isolated up to a maximum acceptable leakage based on the specifications of the tight shut off valve). Tight shut off (maximum acceptable leakage) requirements can vary depending on the composition of the process gas 102. For example, isolation for hazardous fluids (such as hydrogen sulfide, hydrochloric acid, and sulfuric acid) have a direct, detrimental safety impact on human beings, isolation of flammable fluids require consideration of potential fire, and isolation of utility services (such as air or water) has only a potential impact of fluid loss. The maximum acceptable leakage rates of these examples can therefore vary.

The system 100A can include a controller 140. The controller 140 can be communicatively coupled to the compressor 110, to the suction throttling valve 103, to the anti-surge control valve 123, and to the bypass control valve 133. In some implementations, the controller 140 is communicatively coupled to one or more sensors (such as a pressure sensor, a temperature sensor, a flowmeter, or any combination of these). The controller 140 can monitor various process conditions of the system 100A (for example, operating temperature, operating pressure, flow rate, compressor rotation speed) and control opening and closing of valves (for example, the suction throttling valve 103, the anti-surge control valve 123, the bypass control valve 133, or any combination of these) in the system 100A. For example, the controller 140 can determine a compressor rotation speed of the compressor 110 and compare the compressor rotation speed with a specified rated speed. The controller 140 can transmit a close signal to the bypass control valve 133 once it has been determined that the compressor rotation speed has reached the specified rated speed (startup of the compressor 110 has completed). As another example, the controller 140 can determine a flow rate of the process gas 102 flowing through the compressor 110 and compare the flow rate with a specified minimum flow rate of the compressor 110. The controller 140 can transmit an open signal to the anti-surge control valve 123 to open the anti-surge control valve 123 once it has been determined that the flow rate of the process gas 102 flowing through the compressor 110 has dropped to the specified minimum flow rate. In some cases, the controller 140 determines an operating point of the compressor 110 (for example, reduced pressure head ($h_r$) and reduced flow ($q_r^2$) and comparing the operating point with a surge parameter ($S_s$). For example, the controller 140 determines a deviation parameter (DEV) which equals 0 along a surge control line. When DEV falls below 0 (is negative), the compressor 110 is at risk of (or currently in a state of) surging. Thus, it can be favorable for the compressor 110 to operate, such that DEV remains non-negative (DEV≥0) or positive (DEV>0). In some implementations, the controller 140 transmits the open signal to the anti-surge control valve 123 to open the anti-surge control valve 123 once it has been determined that DEV has fallen below 0 (DEV<0). In some implementations, the controller 140 transmits a close signal to the anti-surge control valve 123 to close the anti-surge control valve 123 once it has been determined that DEV has returned to being non-negative (DEV≥0) or has become positive (DEV>0). DEV is sometimes alternatively referred to as a compressor process surge value. In some implementations, the controller 140 monitors a percent opening of the anti-surge control valve 123 and opens the bypass control valve 133 with the anti-surge control valve 123. For example, the controller 140 can determine whether a percent opening of the anti-surge control valve 123 has increased, and the controller 140 can transmit an open signal to the bypass control valve 133 in response to determining that the percent opening of the anti-surge valve 123 has increased (for example, has opened from being in a close state (0% percent opening)).

The controller 140 can include one or more processors 141 and a non-transitory computer-readable storage medium (memory) 143. The processor 141 may be a microprocessor, a multi-core processor, a multithreaded processor, an ultra-low-voltage processor, an embedded processor, or a virtual processor. In some implementations, the processor 141 may be part of a system-on-a-chip (SoC) in which the processor 141 and the other components of the controller 140 are formed into a single integrated electronics package. In some implementations, the processor 141 may include processors from Intel® Corporation of Santa Clara, California, from Advanced Micro Devices, Inc. (AMD) of Sunnyvale, California, or from ARM Holdings, LTD., Of Cambridge, England. Any number of other processors from other suppliers may also be used. Generally, the processor 141 executes instructions and manipulates data to perform the operations of the controller 140 and any algorithms, methods, functions, processes, flows, and procedures as described in this specification. The processor 141 may communicate with other components of the controller 140 over a bus. The bus may include any number of technologies, such as industry standard architecture (ISA), extended ISA (EISA), peripheral component interconnect (PCI), peripheral component interconnect extended (PCIx), PCI express (PCIe), or any number of other technologies. The bus may be a proprietary bus, for example, used in an SoC based system. Other bus technologies may be used, in addition to, or instead of, the technologies above.

The memory 143 is coupled to the one or more processors 141 and stores programming instructions for execution by the one or more processors 141. The programming instructions instruct the one or more processors 141 to perform operations. The memory 143 can hold data for the controller 140 or other components (or a combination of both) that can be connected to the network. While memory 143 is illustrated as an integral component of the controller 140, the memory 143 can be external to the controller 140. The memory 143 can be a transitory or non-transitory storage medium. In some implementations, such as in PLCs and other process control units, the memory 143 is integrated with a database used for long-term storage of programs and data. The memory 143 can include any number of volatile and nonvolatile memory devices, such as volatile random-access memory (RAM), static random-access memory (SRAM), flash memory, and the like. In smaller devices, such as PLCs, the memory 143 may include registers associated with the processor 140 itself. In some implementations, a ratio of an inner diameter of the bypass flowline 131 to an inner diameter of the anti-surge flowline 121 is in a range of from 8:26 to 12:22 (from about to about 0.55). For example, the ratio of the inner diameter of the bypass flowline 131 to the inner diameter of the anti-surge flowline 121 is about 5:12 (about 0.42). In some implementations, a ratio of the inner diameter of the bypass flowline 131 to an inner diameter of the inlet flowline 101 is in a range of from 8:32 to 12:28 (from about 0.25 to about 0.43). For example, the ratio of the inner diameter of the bypass flowline 131 to the inner diameter of the inlet flowline 101 is about 1:3 (about 0.33). In some implementations, a ratio of the inner diameter of the bypass flowline 131 to an inner diameter of the outlet flowline 111 is in a range of from 8:20 to 12:16 (from about 0.40 to about 0.75). For example, the ratio of the inner diameter of the bypass flowline 131 to the inner diameter of the outlet flowline 111 is about 5:9 (about 0.56).

EXAMPLE

This paragraph provides details of one, specific example implementation of the system 100A. The design flow rate to the compressor 110 is 325 million standard cubic feet per day (MMSCFD). The minimum flow rate to the compressor 110 is 225 MMSCFD. The design rotation speed of the compressor 110 is 8,930 rotations per minute (rpm). The inner diameter of the inlet flowline 101 is 30 inches. The suction throttling valve 103 is a 30-inch control valve. The knockout drum 105 has a diameter of 11 feet and 4 inches. The knockout drum 105 has a tangent-to-tangent length of 22 feet and 11.5 inches. The inner diameter of the outlet flowline 111 is 18 inches. The design cooling duty of the cooler 113 is −78 million British thermal units per hour (MMBtu/hr). The inner diameter of the anti-surge flowline 121 is 24 inches. The anti-surge control valve 123 is a 24-inch control valve. The inner diameter of the bypass flowline 131 is 10 inches. The bypass control valve 133 is a 10-inch tight shut off valve.

Figure 1B:
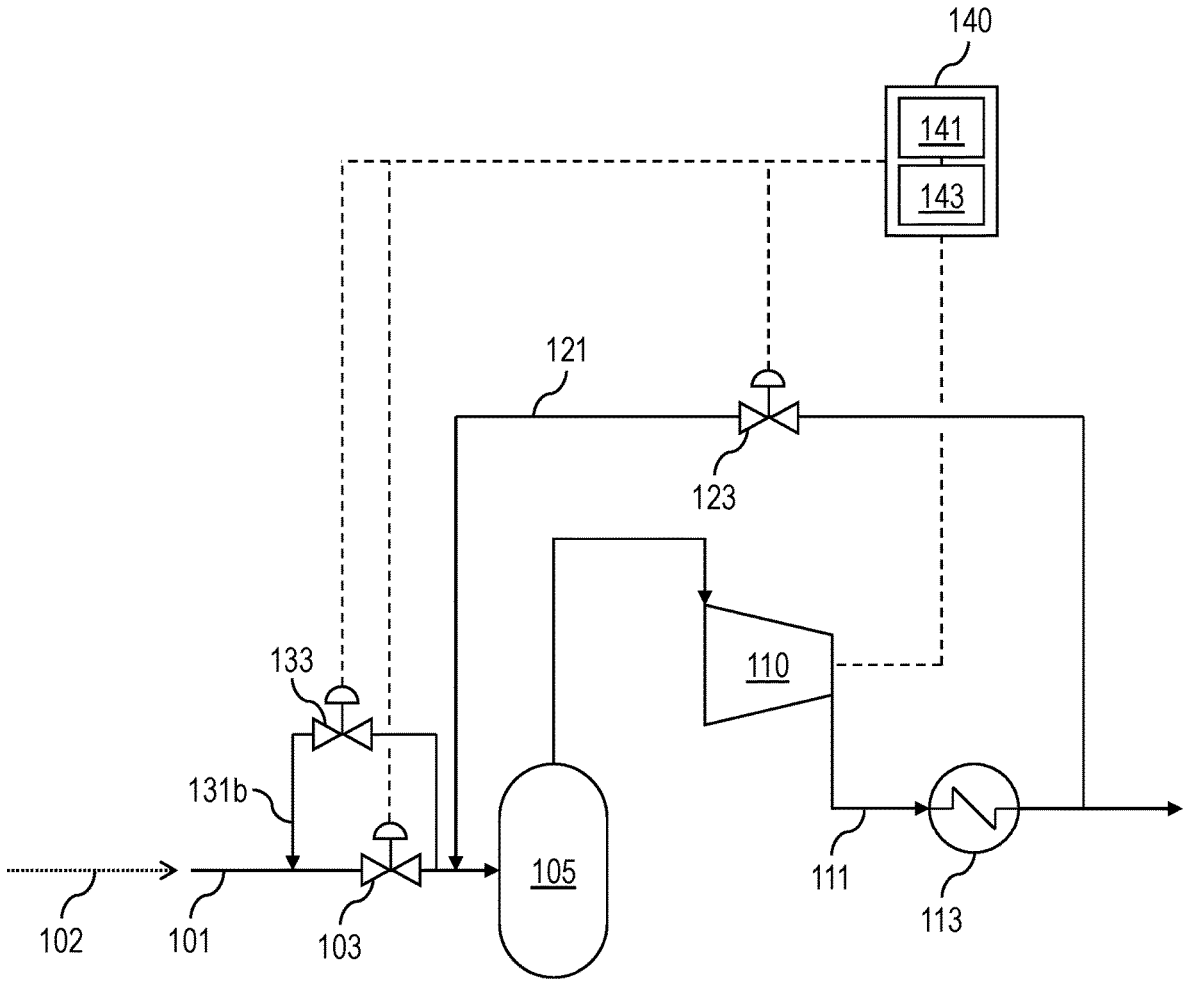
FIG. 1B is a schematic diagram of an example system for soft startup of a centrifugal compressor.

FIG. 1B depicts an example system 100B that can be used for soft startup of a centrifugal compressor 110 (for example, for commissioning the compressor 110 or re-starting the compressor 110 after the compressor 110 has tripped). The system 100B can be substantially similar to the system 100A. The bypass flowline 131*b* of the system 100B effectively performs the same function as the bypass flowline 131 of the system 100A of diverting a portion of the flow from the anti-surge flowline 121, but has different connection points. In contrast to the bypass flowline 131 of the system 100A, the bypass flowline 131*b* of system 100B branches from the inlet flowline 101 intermediate of the suction throttling valve and a point at which the anti-surge flowline is connected to the inlet flowline, and the bypass flowline 131*b* connects back to the inlet flowline 101 upstream of the suction throttling valve 103. Similar to the bypass flowline 131 of the system 100A, the bypass flowline 131*b* of system 100B provides an alternative flow path for the second portion of the process gas 102 flowing through the anti-surge flowline 121 to the inlet flowline 101 around the suction throttling valve 103.

Figure 2:
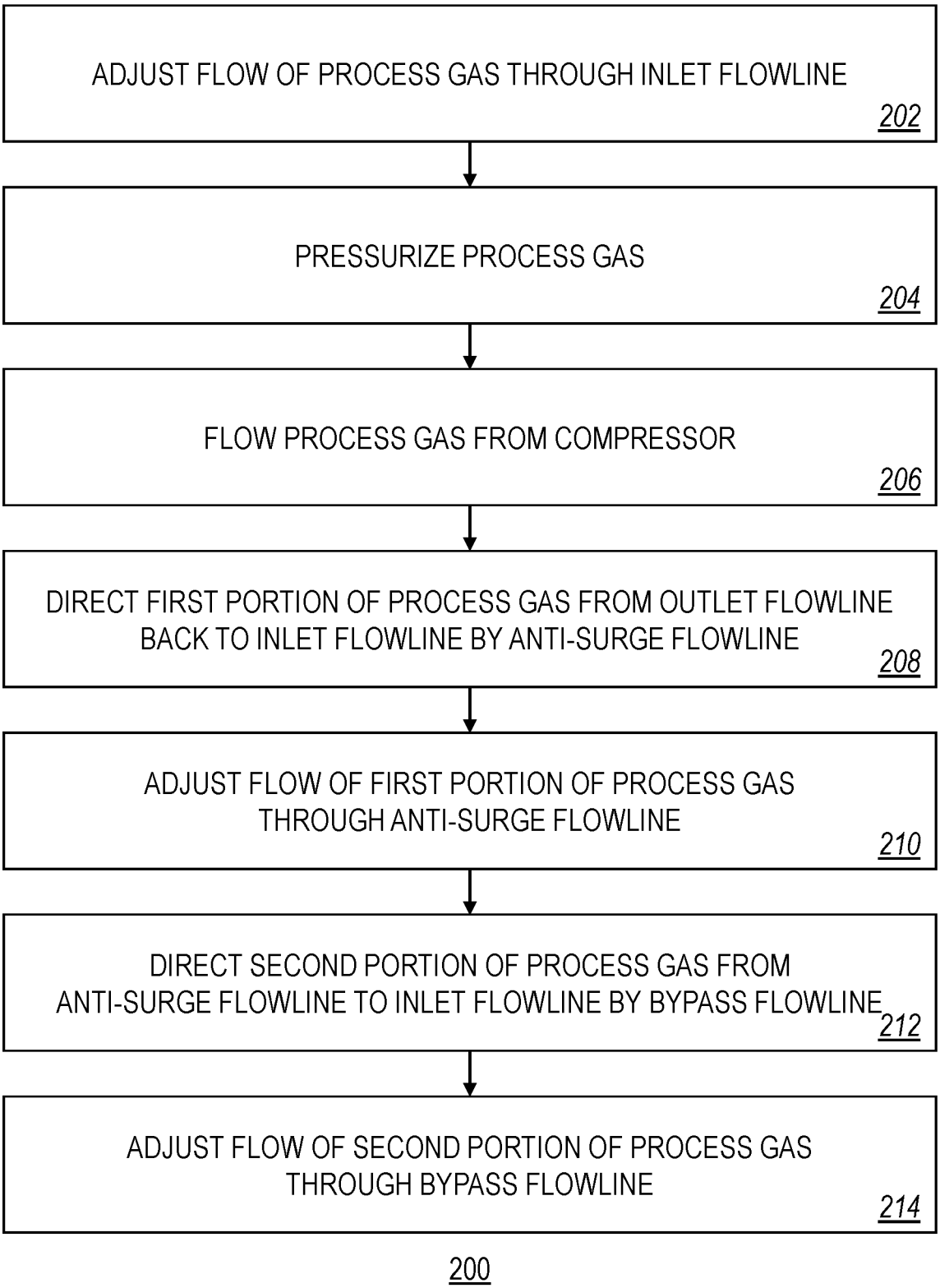
FIG. 2 is a flow chart of an example method for soft startup of a centrifugal compressor.

FIG. 2 is a flow chart of an example method 200 for soft startup of a centrifugal compressor (such as the compressor 110), for example, for commissioning the compressor 110 or re-starting the compressor 110 after the compressor 110 has tripped. Any of the systems 100A or 100B can, for example, implement method 200. At block 202, a suction throttling valve (such as the suction throttling valve 103) adjusts flow of a process gas (such as the process gas 102) through an inlet flowline (such as the inlet flowline 101). In some implementations, the process gas 102 flows through a knockout drum (such as the knockout drum 105), and the knockout drum 105 removes liquid from the process gas 102 prior to proceeding to block 204. At block 204, a compressor (such as the compressor 110) downstream of the suction throttling valve 103 pressurizes the process gas 102. At block 206, an outlet flowline (such as the outlet flowline 111) flows the process gas 102 from the compressor 110. In some implementations, the process gas 102 flows from the compressor 110 and through a cooler (such as the cooler 113), and the cooler 113 cools the process gas 102 prior to proceeding to block 208. At block 208, an anti-surge flowline (such as the anti-surge flowline 121) directs a first portion of the process gas 102 from the outlet flowline 111 back to the inlet flowline 101. As described previously, the anti-surge flowline 121 branches from the outlet flowline 111 and is connected to the inlet flowline 101 intermediate of the suction throttling valve 103 and the compressor 110. At block 210, an anti-surge control valve (such as the anti-surge control valve 123) adjusts flow of the first portion of the process gas 102 through the anti-surge flowline 121 to the inlet flowline 101. At block 212, a bypass flowline (such as the bypass flowline 131) directs a second portion of the process gas 102 from the anti-surge flowline 121 to the inlet flowline 101. In some implementations, the bypass flowline 131 branches from the anti-surge flowline 121 and is connected to the inlet flowline 101 upstream of the suction throttling valve 103 (as is the case for system 100A shown in FIG. 1A). In some implementations, the bypass flowline 131 branches from the inlet flowline 101 and connects back to the inlet flowline 101 around the suction throttling valve 103 (as is the case for system 100B shown in FIG. 1B). The bypass flowline 131 provides an alternative flow path for the second portion of the process gas 102 flowing through the anti-surge flowline 121 to the inlet flowline 101 around the suction throttling valve 103. At block 214, a bypass control valve (such as the bypass control valve 133) adjusts flow of the second portion of the process gas 102 through the bypass flowline 131 to the inlet flowline 101.

In some implementations, the method 200 includes determining (for example, by the controller 140) a compressor rotation speed of the compressor 110 and comparing the compressor rotation speed with a specified rated speed. The method 200 can include closing the bypass control valve 133 in response to determining that the compressor rotation speed has reached the specified rated speed. Closing the bypass control valve 133 shuts off flow of the second portion of the process gas 102 through the bypass flowline 131. In some implementations, the method 200 includes determining (for example, by the controller 140) a flow rate of the process gas 102 flowing through the compressor 110 and comparing the flow rate with a specified minimum flow rate. The method 200 can include opening the anti-surge control valve 123 in response to determining that the flow rate of the process gas 102 flowing through the compressor 110 has dropped to or below the specified minimum flow rate. In some implementations, the method 200 includes determining (for example, by the controller 140) the deviation parameter (DEV). The method 200 can include opening the anti-surge control valve 123 in response to determining that the deviation parameter has fallen below 0 (DEV<0). The method 200 can include closing the anti-surge control valve 123 in response to determining that the deviation parameter has become non-negative (DEV≥0) or positive (DEV>0). In some implementations, the method 200 includes determining (for example, by the controller 140) whether a percent opening of the anti-surge control valve 123 has increased. The method 200 can include opening the bypass control valve 133 in response to determining that the percent opening of the anti-surge control valve 123 has increased (for example, has opened).

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A method comprising:

adjusting, by a suction throttling valve, flow of a process gas through an inlet flowline;

pressurizing, by a compressor downstream of the suction throttling valve, the process gas;

flowing, by an outlet flowline, the process gas from the compressor;

directing, by an anti-surge flowline branching from the outlet flowline, a first portion of the process gas from the outlet flowline back to the inlet flowline, wherein the anti-surge flowline is connected to the inlet flowline intermediate of the suction throttling valve and the compressor;

adjusting, by an anti-surge control valve, flow of the first portion of the process gas through the anti-surge flowline to the inlet flowline;

directing, by a bypass flowline branching from the anti-surge flowline, a second portion of the process gas from the anti-surge flowline to the inlet flowline, wherein the bypass flowline is connected to the inlet flowline upstream of the suction throttling valve, and the bypass flowline provides an alternative flow path for the second portion of the process gas flowing through the anti-surge flowline to the inlet flowline around the suction throttling valve; and adjusting, by a bypass control valve, flow of the second portion of the process gas through the bypass flowline to the inlet flowline around the suction throttling valve.

2. The method of claim 1, comprising:

determining a compressor rotation speed of the compressor;

comparing the compressor rotation speed with a specified rated speed; and closing the bypass control valve in response to determining that the compressor rotation speed has reached the specified rated speed, thereby shutting off flow of the second portion of the process gas through the bypass flowline.

3. The method of claim 2, comprising:

determining a flow rate of the process gas flowing through the compressor;

comparing the flow rate of the process gas flowing through the compressor with a specified minimum flow rate; and opening the anti-surge control valve in response to determining that the flow rate of the process gas flowing through the compressor has dropped to the specified minimum flow rate.

4. The method of claim 3, comprising:

determining whether a percent opening of the anti-surge control valve has increased; and opening the bypass control valve in response to determining that the percent opening of the anti-surge control valve has increased.

5. The method of claim 4, wherein the bypass control valve is a tight shut off valve.

6. The method of claim 5, wherein a ratio of an inner diameter of the bypass flowline to an inner diameter of the anti-surge flowline is in a range of from 8:26 to 12:22.

7. The method of claim 6, wherein a ratio of the inner diameter of the bypass flowline to an inner diameter of the inlet flowline is in a range of from 8:32 to 12:28.

8. The method of claim 7, wherein a ratio of the inner diameter of the bypass flowline to an inner diameter of the outlet flowline is in a range of from 8:20 to 12:16.

9. A system comprising:

an inlet flowline configured to flow a process gas;

a suction throttling valve installed on the inlet flowline, the suction throttling valve configured to control flow of the process gas through the inlet flowline;

a compressor downstream of the suction throttling valve, the compressor configured to pressurize the process gas;

an outlet flowline configured to flow the process gas from the compressor;

an anti-surge flowline branching from the outlet flowline and connected to the inlet flowline intermediate of the suction throttling valve and the compressor;

an anti-surge control valve installed on the anti-surge flowline, the anti-surge control valve configured to control flow of a first portion of the process gas from the outlet flowline through the anti-surge flowline to the inlet flowline;

a bypass flowline branching from the anti-surge flowline and connected to the inlet flowline upstream of the suction throttling valve, the bypass flowline providing an alternative flow path for a second portion of the process gas flowing through the anti-surge flowline to the inlet flowline around the suction throttling valve; and a bypass control valve installed on the bypass flowline, the bypass control valve configured to control flow of the second portion of the process gas from the anti-surge flowline through the bypass flowline to the inlet flowline around the suction throttling valve.

10. The system of claim 9, comprising a controller communicatively coupled to the compressor, to the suction throttling valve, to the anti-surge control valve, and to the bypass control valve, the controller comprising:

one or more processors; and a non-transitory computer-readable storage medium coupled to the one or more processors and storing programming instructions for execution by the one or more processors, the programming instructions instructing the one or more processors to perform operations comprising:

determining a compressor rotation speed of the compressor;

comparing the compressor rotation speed with a specified rated speed; and transmitting a close signal to the bypass control valve to close the bypass control valve in response to determining that the compressor rotation speed has reached the specified rated speed.

11. The system of claim 10, wherein the programming instructions instruct the one or more processors to perform operations comprising:

determining a flow rate of the process gas flowing through the compressor;

comparing the flow rate of the process gas flowing through the compressor with a specified minimum flow rate; and transmitting an open signal to the anti-surge control valve to open the anti-surge control valve in response to determining that the flow rate of the process gas flowing through the compressor has dropped to the specified minimum flow rate.

12. The system of claim 11, wherein the programming instructions instruct the one or more processors to perform operations comprising:

determining whether a percent opening of the anti-surge control valve has increased; and transmitting a second open signal to the bypass control valve to open the bypass control valve in response to determining that the percent opening of the anti-surge control valve has increased.

13. The system of claim 12, wherein the bypass control valve is a tight shut off valve.

14. The system of claim 13, wherein a ratio of an inner diameter of the bypass flowline to an inner diameter of the anti-surge flowline is in a range of from 8:26 to 12:22.

15. The system of claim 14, wherein a ratio of the inner diameter of the bypass flowline to an inner diameter of the inlet flowline is in a range of from 8:32 to 12:28.

16. The system of claim 15, wherein a ratio of the inner diameter of the bypass flowline to an inner diameter of the outlet flowline is in a range of from 8:20 to 12:16.

17. A system comprising:

an inlet flowline configured to flow a process gas;

a suction throttling valve installed on the inlet flowline, the suction throttling valve configured to control flow of the process gas through the inlet flowline;

a compressor downstream of the suction throttling valve, the compressor configured to pressurize the process gas;

an outlet flowline from the compressor;

an anti-surge flowline branching from the outlet flowline and connected to the inlet flowline intermediate of the suction throttling valve and the compressor;

an anti-surge control valve installed on the anti-surge flowline, the anti-surge control valve configured to control flow of a first portion of the process gas from the outlet flowline through the anti-surge flowline to the inlet flowline;

a bypass flowline branching from the anti-surge flowline and connected to the inlet flowline upstream of the suction throttling valve, the bypass flowline providing an alternative flow path for a second portion of the process gas flowing through the anti-surge flowline to the inlet flowline around the suction throttling valve;

a bypass control valve installed on the bypass flowline, the bypass control valve configured to control flow of the second portion of the process gas from the anti-surge flowline through the bypass flowline to the inlet flowline around the suction throttling valve; and a controller communicatively coupled to the compressor, to the suction throttling valve, to the anti-surge control valve, and to the bypass control valve, the controller comprising:

one or more processors; and a non-transitory computer-readable storage medium coupled to the one or more processors and storing programming instructions for execution by the one or more processors, the programming instructions instructing the one or more processors to perform operations comprising:

determining a compressor rotation speed of the compressor;

comparing the compressor rotation speed with a specified rated speed; and transmitting a close signal to the bypass control valve in response to determining that the compressor rotation speed has reached the specified rated speed.

18. The system of claim 17, wherein the programming instructions instruct the one or more processors to perform operations comprising:

determining a flow rate of the process gas flowing through the compressor;

comparing the flow rate of the process gas flowing through the compressor with a specified minimum flow rate; and transmitting an open signal to the anti-surge control valve to open the anti-surge control valve in response to determining that the flow rate of the process gas flowing through the compressor has dropped to the specified minimum flow rate.

19. The system of claim 18, wherein the programming instructions instruct the one or more processors to perform operations comprising:

determining whether a percent opening of the anti-surge control valve has increased; and transmitting a second open signal to the bypass control valve to open the bypass control valve in response to determining that the percent opening of the anti-surge control valve has increased.

20. The system of claim 19, wherein:

a ratio of an inner diameter of the bypass flowline to an inner diameter of the anti-surge flowline is about 5:12;

a ratio of the inner diameter of the bypass flowline to an inner diameter of the inlet flowline is about 1:3; and a ratio of the inner diameter of the bypass flowline to an inner diameter of the outlet flowline is about 5:9.

* * * * *